US005253027A

United States Patent [19]

Goto

[11] Patent Number: 5,253,027

[45] Date of Patent: Oct. 12, 1993

[54] IMAGE FIXING ROTATABLE MEMBER AND IMAGE FIXING APPARATUS WITH SAME

[75] Inventor: Masahiro Goto, Kawasaki, Japan

[73] Assignee: Canon Kabushiki Kaisha, Tokyo, Japan

[21] Appl. No.: 733,957

[22] Filed: Jul. 22, 1991

Related U.S. Application Data

[63] Continuation of Ser. No. 504,081, Apr. 4, 1990, abandoned, which is a continuation of Ser. No. 229,659, Aug. 8, 1988, abandoned.

[30] Foreign Application Priority Data

Aug. 7, 1987 [JP] Japan ..... 62-196332
Sep. 14, 1987 [JP] Japan ..... 62-228268

[51] Int. Cl.[5] ..... G03G 15/20

[52] U.S. Cl. ..... 355/290; 355/282; 355/285; 355/289; 492/56

[58] Field of Search ..... 355/282, 285, 289, 290, 355/293, 289; 29/130, 132, 895, 895.21, 895.211, 895.3, 895.32, 110; 428/380, 383, 390

[56] References Cited

U.S. PATENT DOCUMENTS

| | | | |
|---|---|---|---|
| 4,078,286 | 3/1978 | Takiguichi et al. | 29/132 |
| 4,149,797 | 4/1979 | Imperial | 355/290 |
| 4,309,803 | 1/1982 | Blaszak | 29/132 X |
| 4,320,714 | 3/1982 | Shimazaki et al. | 430/99 X |
| 4,368,568 | 1/1983 | Watanabe | 29/132 X |
| 4,372,246 | 2/1983 | Azar et al. | 118/60 |
| 4,430,406 | 2/1984 | Newkirk et al. | 29/132 X |
| 4,501,482 | 2/1985 | Stryjewski | 29/132 X |
| 4,521,095 | 6/1985 | Mayer | 355/285 |
| 4,550,243 | 10/1985 | Inagaki | 432/60 X |
| 4,596,920 | 6/1986 | Inagaki | 355/290 X |
| 4,763,158 | 8/1988 | Schlueter | 355/290 X |
| 4,827,868 | 5/1989 | Tarumi et al. | 29/132 X |
| 4,829,931 | 5/1989 | Mogi | 355/289 X |

FOREIGN PATENT DOCUMENTS

| | | | |
|---|---|---|---|
| 0186314A3 | 2/1986 | European Pat. Off. . | |
| 0302517A2 | 2/1989 | European Pat. Off. . | |
| 3539377A1 | 5/1986 | Fed. Rep. of Germany . | |
| 3606662A1 | 9/1986 | Fed. Rep. of Germany . | |
| 0039134 | 4/1978 | Japan | 118/60 |
| 0077534 | 7/1978 | Japan | 335/282 |
| 0041331 | 12/1979 | Japan | 355/289 |
| 0046667 | 3/1984 | Japan | 355/290 |
| 0217010 | 12/1984 | Japan | 29/132 |
| 0260076 | 12/1985 | Japan | 355/290 |
| 0137179 | 6/1986 | Japan | 355/290 |
| 0158361 | 7/1986 | Japan | 355/289 |
| 0173279 | 8/1986 | Japan | 355/290 |
| 0104072 | 5/1988 | Japan | 355/282 |
| 0139380 | 6/1988 | Japan | 355/282 |
| 0298382 | 12/1988 | Japan | 355/282 |

OTHER PUBLICATIONS

The American Heritage Dictionary, Houghton Mifflin Co. 1976, p. 1052.

Japanese Patent Abstracts vol. 10, No. 380(p-528) [2437], Dec. 19, 1986.

Japanese Patent Abstract vol. 10, No. 64 (p-436) [2121], Mar. 14, 1986.

Japanese Patent Abstract vol. 10, No. 364 (p-524) [2421], Dec. 5, 1986.

Official Letter and European Search Report dated Jan. 25, 1990.

*Primary Examiner*—A. T. Grimley
*Assistant Examiner*—Matthew S. Smith
*Attorney, Agent, or Firm*—Fitzpatrick, Cella, Harper & Scinto

[57] ABSTRACT

A rotatable member for image fixing includes an elastic layer; and a resin layer formed on the elastic layer by applying resin material and sintering it; and wherein the elastic layer contains resin material.

19 Claims, 2 Drawing Sheets

IMAGE FIXING ROTATABLE MEMBER AND IMAGE FIXING APPARATUS WITH SAME

This application is a continuation of application Ser. No. 504,081 filed Apr. 4, 1990, now abandoned, and parent application Ser. No. 229,659 filed Aug. 8, 1988, now abandoned.

FIELD OF THE INVENTION RELATED ART

The present invention relates to an image fixing rotatable member and an image fixing apparatus having the same, usable with an electrophotographic apparatus or the like to fix an unfixed image, more particularly to the image fixing rotatable member having an elastic layer and a resin layer.

An image fixing rotatable member has been proposed which comprises an elastic layer of silicone rubber or the like and a resin layer of fluorine resin or the like applied and sintered thereon, which exhibits good elasticity and parting characteristics, and therefore, which is particularly suitable for a high speed image fixing apparatus, as disclosed in U.S. Ser. Nos. 793,546, 831,729, 877,849 and 094,418.

The image fixing rotatable member of this type has a very thin and pure resin layer on the elastic layer, so that the image fixing properties and releasing or parting properties are good.

However, when the image fixing operation is repeated with this rotatable member, it has been found that the resin layer is peeled off the elastic layer although the surface resin layer itself and the elastic layer itself are still sufficient for image fixing operation, with the result that the image fixing rotatable member has to be exchanged.

SUMMARY OF THE INVENTION

Accordingly, it is a principal object of the present invention to provide an image fixing rotatable member and an image fixing apparatus having the same, in which the resin layer more firmly adheres to the elastic layer, by which the service life thereof is increased.

It is another object of the present invention to provide an image fixing apparatus in which good image fixing operations are stably performed for a long period of time.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
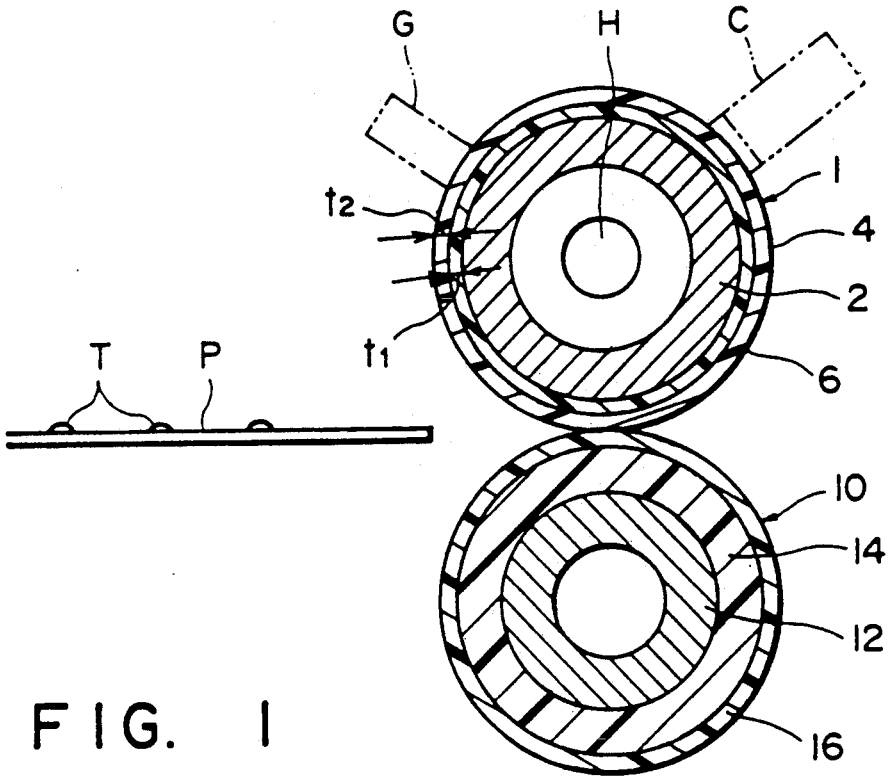
FIG. 1 is a sectional view of an image fixing apparatus according to an embodiment of the present invention.

The preferred embodiments of the present invention will be described in conjunction with the accompanying drawings wherein the elements having corresponding functions are assigned the same reference numerals.

Figure 2:
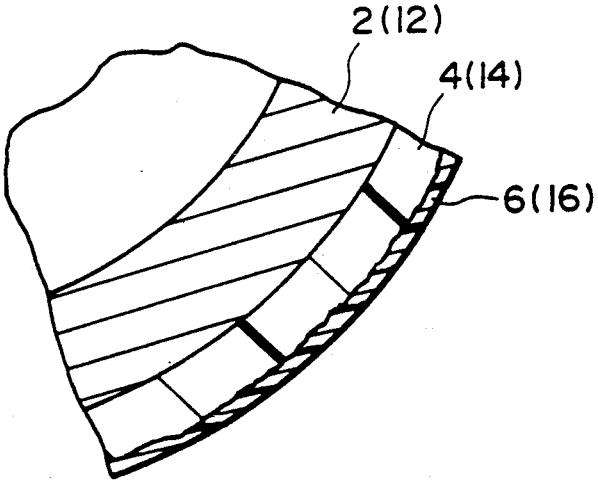
FIG. 2 is an enlarged sectional view of a part of an image fixing rotatable member according to the embodiment of FIG. 1 of the present invention.

Referring to FIGS. 1 and 2, there are shown an image fixing apparatus and a roller therefor according to an embodiment of the present invention.

In FIG. 1, a heating roller 1 is adapted to contact a toner image T to be fixed and includes a heating source such as a halogen heater therein. A back-up roller 10 for pressing the toner image T to the heating roller 1 is provided. The heating roller 1 and the back-up roller 10 provide a nip therebetween, through which a recording sheet P supporting an unfixed toner image T is passed, whereby the toner image T is fixed by the heat and pressure.

The heating roller 1 and the back-up roller 10 have similar structures, and each comprises a core metal 2 or 12, an elastic layer 4 or 14, and a resin layer 6 or 16.

The image fixing apparatus further comprises a temperature detecting and control means G for detecting the surface temperature of the heating roller 1 and for maintaining the surface temperature at an optimum toner-fusing temperature, for example, 160°-200° C., and an offset preventing liquid applying means C for applying off-set preventing liquid such as silicone oil on the surface of the heating roller 1 and for cleaning the surface of the heating roller 1.

The core metal 2 of the heating roller 1 is made of a material having good thermal conductivity such as aluminum, and the elastic layer 4 is made of silicone rubber exhibiting good elastic properties. The elastic layer has, in this embodiment, a layer thickness $t_1a$ of 0.3-0.8 mm (FIG. 1) and an impact resilience of 65-85%. The resin layer 6 is of fluorine resin such as PFA (copolymer of tetrafluoroethylene resin and perfluoroalkoxyethylene resin) and PTFE resin (tetrafluoroethylene resin) exhibiting good parting properties. In this embodiment, the resin layer has a layer thickness $t_3$ of 10-25 microns (FIG. 1), and the film strength is not less than 50 kg/cm$^2$.

On the other hand, the pressing roller 10 has a structure similar to the heating roller 1. The core metal 12 is made of stainless steel or iron. The thickness $t_3$ of the silicone rubber elastic layer 14 (FIG. 1) is larger than that of the heating roller, for example, 4-10 mm. The impact resilience thereof is 65-85%. The resin layer 16 is, similarly to the resin layer of the heating roller 1, made of fluorine resin such as PFA and PTFE. The thickness $t_4$ (FIG. 1) thereof is 5-35 microns, and the film strength thereof is not less than 50 kg/cm$^2$.

Each of the heating and pressing rollers 1 and 10 is symmetrical about a center in the direction of the length thereof, and preferably each of them is a reverse-crowned, by which the diameter in the central portion is slightly smaller than those at the longitudinal end portions.

According to this embodiment, each of the heating roller 1 and the pressing roller 10 has the elastic layer 4 or 14 and the resin layer 6 or 16. The silicone rubber is used for the elastic layer 4 or 14, and fluorine resin is mixed and dispersed in the silicone rubber. By using such a silicone rubber layer for the elastic layer, an image fixing roller exhibiting sufficient image fixing properties, durability and parting properties is realized.

The description will be made, hereinafter, as to results of experiment with examples wherein the image fixing roller is used in the image fixing apparatus according to embodiments of the present invention, and as to results of comparison examples wherein the present invention is not incorporated and wherein the elastic layer is made of silicone rubber without resin material mixed thereinto.

In the experiments, an aluminum core metal 2 is prepared for the heating roller 1, and it has been finished such that the outer diameter at the central portion 1 is 58.3 mm with an amount of the reverse-crown of 150 microns, and the thickness thereof is 6.5 mm. The surface thereof is sand-blasted to be degreased and then dried. During the production, a primer has been applied on the surface of the core metal. It is then wrapped with a vulcanizable type silicone rubber sheet into which PTFE particles having a particle size of not more than 1 micron (preferably not more than 0.5 micron) are mixed and dispersed at the time of kneading (5–30% by weight relative to silicone rubber (100%)). It is press-vulcanized for 30 minutes at 160° C., and thereafter, it is machined to the rubber thickness of 0.5 mm, by which a silicone rubber roller is produced. The silicone rubber layer thus produced is coated with PTFE dispersion in a thickness of 20 microns by spray. The PTFE resin is sintered by a sintering method by which the silicone rubber roller is not heat-deteriorated too much. The sintering method will be described hereinafter.

The back-up roller 10 is produced in the manner similar to that for the heating roller 1. The core metal 12 is made of iron, but the same materials are used for the elastic layer 14 and the resin layer. The layer thickness, however, of the elastic layer 14 is 6 mm, and that of the resin layer is 25 microns. The outside diameter of the roller is the same as the heating roller 1.

Example 1

Experiments were carried out with the heating roller 1 and the back-up roller 10 described above with respect to image fixing properties, parting properties, bonding properties and durability. The surface temperature of the heating roller 1 was maintained at 180° C. The sheets having A4 size (JIS) were processed at a process speed of 200 mm/sec, 30 sheets/min. The image fixing properties were evaluated in the following manner.

Nine solid black circle images having a diameter of 24 mm were formed on an A4 size (JIS) sheet having a basic weight of 80 g/m$^2$ under the temperature of 10° C. The image density is expressed by D0. The image was rubbed by non-woven fabric under the pressure of 40 g/cm$^2$ through ten reciprocations. The used non-woven fabric was "Kojin Wiper", available from Kabushiki Kaisha Kojin, Japan (called "paper waste", trade name) having a softness like tissue paper and rough surface like the grain of wood and having a crape ratio of 32±3%, a weight of 35±3 g/m$^2$, a tensile strength (longitudinal direction) of 0.4 kg/15 mm or more, and a thickness of 200 microns, which is disposable. The image density after the rubbing is expressed as D1, the fixing ratio is determined by (D1/D0)×100 (%).

The image densities D1 and D0 were measured by a MacBeth reflection type image density meter. The image density D0 was controlled so as to be not less than 1.0 and not more than 1.1. The parting properties were determined by a method wherein a whole surface solid black image was formed and fixed continuously on 100 transfer sheets of the same type under the same conditions, and thereafter, a white sheet was passed through the fixing apparatus, and then, the contamination of the white sheet was observed.

The bonding strength between the fluorine resin layer and the rubber layer was determined in the following manner. The fluorine resin was partily peeled with a width of 10 mm, and a tension gauge having a full scale of 100–300 g was mounted. The fluorine resin layer was peeled 90 degrees in the circumferential direction, and the read out of the tension gauge was deemed as the bonding strength. At this time, the surface temperature of the heating roller was maintained at 200° C.

The following is the results of the evaluation of the fixing property, parting property, bonding strength and the durability of the heatig roller in the first example:

Fixing property . . . 85% at the worst portion 92% on the average (9 points)

Parting property . . . no contamination

Bonding strength . . . 130 g/10 mm

Durability . . . Heating roller: the PTFE coating was partly peeled at a position corresponding to the separation pawl when 350,000 sheets were processed. Back-up roller: the PTFE coating was partly peeled at a position corresponding to a side of the sheet when 280,000 sheets were processed.

As will be understood, it has been confirmed that both of the rollers have sufficiently practical properties.

A comparison example 1 will be described wherein the fluorine resin is not mixed into the silicone rubber layer, that is, the elastic layer, and then, the reason why the advantages are provided according to this invention will be described.

Comparison Example 1

The heating roller and the back-up roller were produced in the similar manner as in the first embodiment, but the resin material was not mixed into the silicone rubber layer used as the elastic layer. The fixing property, the parting property, the bonding strength and the durability were evaluated under the same conditions as in the Example 1.

Fixing property . . . 85% at worst 93% on the average (9 points)

Parting property . . . no contamination

Bonding strength . . . 85 g/10 mm

Durability . . . Heating roller: PTFE coating was partly peeled at the position corresponding to the pawl when 110,000 sheets were processed. Back-up roller: the PTFE coating was partly peeled at the position corresponding to a side edge of the sheet when 80,000 sheets were processed.

As will be understood from comparison of the above examples, the fixing property and the parting property of the Comparison Example 1 are equivalent to those of the Example 1 of the present invention in the heating and pressing rollers, but the bonding strength and the durability are inferior thereto. The reason for this is considered as being that in the first example of the present invention the PTFE particles are dispersed and mixed in the silicone rubber layer of each of the rollers, and therefore, the PTFE resin particles adjacent to the surface portion of the silicone rubber layer are fused in the sintering operation and are fused with the PTFE layer of the resin layer, whereby a very close bonding state is formed between the PTFE layer and the silicone rubber layer, thus increasing the bonding strength.

In the heating and the back-up rollers in the first example of the present invention, the amount of the PTFE particles mixed into and dispersed in the silicone rubber is such that the particles do not deteriorate the property of the silicone rubber (hardness, impact resilience). Since such an amount is sufficient to the increase of the bonding strength, it is not necessary to accept deterioration of the fixing property and the parting property.

Particularly, the advantageous effects are provided when the particle size of the PTFE particles is not more than 1 micron, further preferably, not more than 0.5 micron, and the content by weight of the particles is 5-30% relative to silicone rubber (100%). This is because the specific surface area of the PTFE particles becomes large with decrease of the particle size of the PTFE particles, and also the bonding strength with the silicone rubber becomes stronger therewith, and because the PTFE particles are uniformly dispersed in the silicone rubber so that the tolerable range of the amount of the PTFE particles becomes large. As regards the upper and lower limits of the amount of dispersed PTFE particles, if it is too small, sufficient bonding strength is not provided, and if it is too large, on the contrary, the property of the rubber (elasticity, elongation, tensile strength or the like) are remarkably deteriorated with the result that it does not perform sufficient function as the fixing roller.

Here, the sintering method for the resin layer of the heating roller and the back-up roller will be described.

As for methods of sintering the resin layer without extreme heat-deterioration of the silicone rubber roller after PTFE dispersion or the like is sprayed and applied on the silicone rubber layer, the surface PTFE layer is quickly heated (for example, the PTFE layer is heated up to above 380° C. for not more than 15 min.) while the rubber layer is quickly cooled (water-cooled or air-cooled) from the inside of the core metal, or the use is made with dielectric heating utilizing the fact that dielectric loss tangent of the liquid PTFE dispersion per se is larger than the dielectric loss tangent of the rubber layer.

Figure 3:
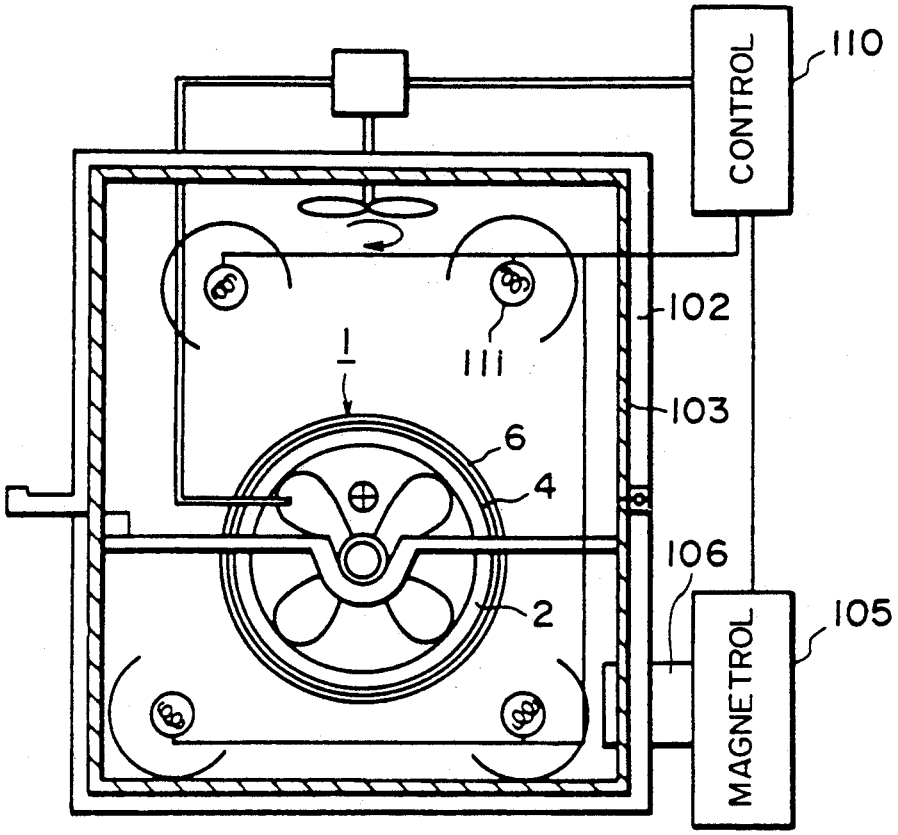
FIG. 3 is a sectional view of an example of an apparatus for manufacturing the image fixing rotatable member according to the embodiment of the present invention.

FIG. 3 shows an example of the apparatus usable for the sintering using the dielectric heating. In this apparatus, both of the dielectric heating and an external infrared heating are employed. The apparatus comprises a magnetron 105, a wave guide 106 for guiding a high frequency wave (950 MHz-2450 MHz) produced by the magnetron 105, an openable resin container 102 connected to the wave guide 106 and having a high frequency wave reflecting plate 103 of a metal on the inside thereof and upper and lower infrared lamp 111 with shade for externally heating with infrared rays. The magentron 105 and the infrared lamp 111 are controlled by control means 110.

In this Figure, the heating roller 1 is shown as an example. Since the heating roller 1 includes the silicone rubber layer 4 in the inside and a fluorine resin coating layer 6 on the surface, the high frequency energy is absorbed more by the fluorine resin coating layer 6 since it has a larger dielectric constant than the silicone rubber layer 4. Therefore, the fluorine resin layer is quickly heated in the constant temperature container by the high frequency wave and the infrared rays, and is completely sintered by the heating for 15 min. to 340° C. After the sintering, the roller is quickly cooled. Suitable surface fluorine resin material is PTFE dispersion available from Daikin Kabushiki Kaisha, Japan (tetrafluoroethylene resin dispersion D-1). The back-up roller 10 is sintered in the same manner.

By using the dielectric heating in this manner, the energy loss can be reduced, and the heat flow into the lower elastic layer can be minimized. The fixing roller 1 and the back-up roller 10 produced in the first example using the dielectric heating had rubber properties of the elastic layer 4, 14 which were generally the same as those had by the roller before the sintering (impact resilicence or the like). The surface fluorine resin layer PFA or PTFE layer 6, 16 was completely sintered to show good releasing property, resistance to wear and the bonding property with the elastic layer.

Figure 4:
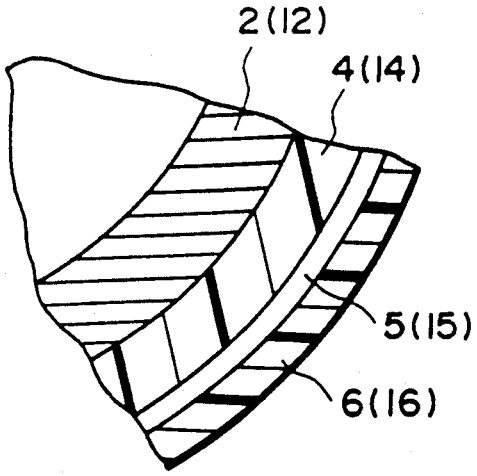
FIGS. 4 and 5 are enlarged sectional views of image fixing rotatable member according to other embodiments of the present invention.

The second example of this invention will be described. The heating roller and the back-up roller in this example have the layer structure as shown in FIG. 4. Each of them has a core metal 2 or 12, an elastic layer 4 or 14, a bonding layer 5 or 15 and a resin layer 6 or 16. The feature of this example is in the provision of the bonding layer 5 or 15 of a resin material between the elastic layer 4 or 14 and the resin layer 6 or 16. The bonding layer 5 or 15 is made of a mixture of PTFE particles and heat-durable resin such as polyamide, polyimide, epoxy or the like resin. The rollers were incorporated into the image fixing apparatus in the same manner as in the first example.

As for the method of manufacturing each of the rollers, liquid provided by dispersing in a solvent the PTFE particles and sheet-durable resin such as polyamide or the like is applied as the bonding layer on the silicone rubber roller by spray in the thickness of 5 microns (heating roller) and in the thickness of 7 microns (the back-up roller), and it is air-dried under room temperature. The other respects are the same as the first example.

Similarly to the first example of the present invention and the first comparison example, the results of the experiments with the roller containing the resin material in the elastic layer and a comparison example roller having a silicone rubber layer without the resin material will be described.

Example 2

The results of experiments under the same conditions as the first example are as follows:

Fixing property . . . 80% at worst 88% on the average (9 points)

Parting property . . . no contamination

Bonding strength . . . 160 g/10 mm

Durability . . . Heating roller: the PTFE coating was partly peeled at a position corresponding to the pawl when 410,000 sheets were processed. Back-up roller: the PTFE coating was partly peeled at a position corresponding to a side edge of the sheet when 330,000 sheets were processed.

As will be understood from the above, the fixing property is slightly inferior to the first example, but it is practically sufficient, and the bonding strength and the durability are superior to the first example.

Comparison Example 2

The heating roller and the back-up roller were produced in the same manner as the above second example of the present invention with the exception that the resin material was not mixed into the silicone rubber layer. The results are:

Fixing property . . . 80% at worst 87% on the average (9 points)

Parting property . . . no contamination
Bonding strength . . . 95 g/10 mm
Durability . . . Heating roller: the PTFE coating was partly peeled at a position corresponding to the pawl when 130,000 sheets were processed. Back-up roller: the PTFE coating was partly peeled at a position corresponding to a side edge of the sheet when 90,000 sheets were processed.

As will be understood from the above, the fixing property and the parting property are equivalent to those of the heating roller and the back-up roller in the second example, but the bonding strength and the durability are inferior. Therefore, it has been confirmed that even if the roller has the bonding layer, it is very effective for providing the sufficient bonding strength and durability to mix the fluorine resin into the elastic layer. The reason for those advantageous effects is considered as being that the PTFE particles in the silicone rubber layer are fused with the PTFE particles in the bonding layer when the resin layer is sintered, and further, the PTFE particles in the bonding layer and the PTFE surface layer are fused together when the surface layer is sintered, so that the strong bonding can be provided. The resin material (polyamide, polyimide, epoxy or the like resin material) in the bonding layer is impregnated into the concave portions of the surface of the silicone rubber, so that the bonding strength is enhanced under the influence of the larger surface energy than the fluorine resin.

The roller having a silicone rubber layer into which the fluorine resin is mixed, and having a bonding layer, is highly durable, and the fixing property thereof is sufficiently practical.

A third example of the present invention will be described.

Each of the heating roller and the back-up roller has the same structure as the above described second example of the present invention (FIG. 4). The feature of this example is in the elastic layer 4 or 14. In this example, when the silicone rubber as the elastic layer 4 or 14 is kneaded, the resin material (polyamide, polyimide, epoxy or the like resin material) used in the bonding layer or a highly heat-fusible resin (polypropyrene or the like) is mixed into the silicone rubber. In this embodiment, polyamide resin particles were mixed thereinto (5% by weight). This example is the same as the above described second example in the other respect such as manufacturing and sintering.

Example 3

The same experiments were carried out for the rollers in the third example. The results are:
Fixing property . . . 77% at worst 84% on the average (9points)
Parting property . . . no contamination
Bonding strength . . . 185 g/10 mm
Durability . . . Heating roller: the PTFE coating was partly peeled at a position corresponding to the pawl when 490,000 sheets were processed. Back-up roller: the PTFE coating was partly peeled at a position corresponding to a side edge of the sheet when 360,000 sheets were processed.

As will be understood, the fixing property is slightly inferior, but it is still above a practical level and the bonding strength and the durability are remarkably improved.

The reason for this is considered as being that the resin material in the silicone rubber layer is fused at the time of the sintering operation, and are fused with the resin material in the bonding layer, so that the very strong bonding can be provided.

The comparison example to be compared with the Example 3 should be the same as the Comparison Example 2.

A fourth example of the present invention will be described. Each of the heating and back-up rollers in this example has the same layer structure as the above-described Examples 2 and 3 (FIG. 4). The feature of this example is in the bonding layer 5 or 15 which is made of a mixture of water soluble fluorine rubber and PFA or PTFE fluorine resin. As regards the elastic layer 4 or 14, the PTFE particles are mixed, similarly to the second example. This example is the same as the above-decribed Example 2 in the other respect such as sintering.

Example 4

The same experiments were performed with the fourth example of the present invention. The results are:
Fixing property . . . 83% at worst 90% on the average (9 points)
Parting property . . . no contamination
Bonding strength . . . 150 g/10 mm
Durability . . . Heating roller: the PTFE coating was partly peeled at a position corresponding to the pawl when 390,000 sheets were processed. Back-up roller: the PTFE coating was partly peeled at a position corresponding to a side edge of the sheet when 330,000 sheets were processed.

As will be understood from the above, the fixig property is very good, and as good as that of the rollers without the bonding layer. It has been confirmed that the bonding strength and the durability are improved.

Comparison Example 3

The same experiments were performed with the heating roller and the back-up roller similar to the Example 4 of the present invention but without the resin material mixed into the silicone rubber layer. The results are:
Fixing property . . . 83% at worst 91% on the average (9 points)
Parting property . . . no contamination
Bonding strength . . . 90 g/10 mm
Durability . . . Heating roller: the PTFE coating was partly peeled at a position corresponding to the pawl when 130,000 sheets were processed. Back-up roller: the PTFE coating was partly peeled at a position corresponding to a side edge of the sheet when 90,000 sheets were processed.

From the results of the Example 4 and the Comparison Example 3, it is understood that the existence of the resin material in the elastic layer is preferable when the bonding layer is of a mixture of the rubber material and the resin material.

The reason for this is considered as being that a strong bonding strength is not provided between rubber materials once the rubber materials have been vulcanized, and the strong bonding strength is provided by the fusing of the resin material dispersed in the rubber layer and the resin material in the bonding layer at the time of the sintering.

Also, it is considered that since the bonding layer is of a mixture of the rubber material and the resin material in Example 4 , the degree of the reduction of the elasticity of the elastic layer due to the exitence of the bonding layer is reduced, so that the fixing property is equivalent to that of the roller without the bonding layer.

In the foregoing description, a heat fixing apparatus has been taken as an example of a preferable application to a fixing rotatable member. However, the present invention is applicable to a pressure fixing apparatus or the like wherein the toner image is fixed by a light pressure, or wherein the image is fixed simultaneously with image transfer. In the foregoing description, the fixing apparatus includes two rollers, but it may comprise three or more rollers.

In addition, the rotatable member is not limited to a roller but may be in the form of a belt.

In the image fixing apparatus according to the foregoing embodiments, both of the heating and back-up rollers have the structure of the present invention. However, the advantageous effects are provided even if the present invention is applied to only one of them.

A further embodiment of the present invention will be described.

Figure 5:
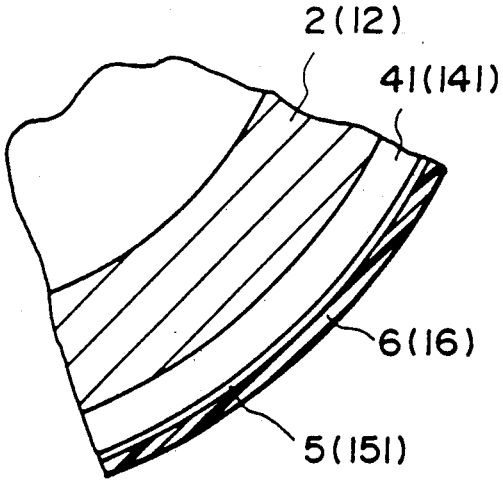

FIG. 5 is a partly enlarged sectional view of a roller for image fixing usable with an image fixing apparatus described in conjunction with FIG. 1.

Each of the heating roller 1 and the back-up roller 10 has a similar structure, more particularly, it comprises a core metal 2 or 12, a first elastic layer 41, 141, a second elastic layer 51, 151 and a surface resin layer 6 or 16. The first elastic layer 41 or 141 is made of a good thermal conductivity material, and the second elastic layer 51 or 151 is made of a good thermally insulative material to which resin material is mixed.

The core metal 2 of the heating roller 1 is made of a material having good thermal conductivity such as aluminum, and the first elastic layer 41 made of fluorine rubber or silicone rubber on the core metal 2. The first elastic layer 41 has, in this embodiment, a thermal conductivity of not less than $0.8\times10^{-3}$ cal.cm/sec.cm$^2$.°C. and a layer thickness of 0.3–2.0 mm. On the first elastic layer 41, a second elastic layer 51 having a smaller thickness than the first elatic layer is formed. The second elastic layer 51, in this embodiment has a thermal conductivity of not more than $0.4\times10^{-3}$ cal.cm/sec.cm$^2$.°C. and a layer thickness of 0.05 mm–0.5 mm.

Then, on the second elastic layer 51, a resin layer 6 having a further smaller thickness, that is, smaller than the second elatic layer is formed. The resin layer 6 is made of fluorine resin such as PFA resin (copolymer of tetrafluoroethylene resin and perfluoroalkoxyethylene resin), PTFE resin (tetrafluoroethylene resin). The resin layer 16 has a layer thickness of 5–35 microns and a film strength of not less than 50 kg/cm$^2$.

On the other hand, the pressing roller 10 has a structure similar to the heating roller 1. The core metal 12 is made of stainless steel or iron. The first elastic layer 141 is made of fluorine rubber or silicone rubber. The first elastic layer 141 has, in this embodiment, a thermal conductivity of not less than $0.8\times10^{-3}$ cal.cm/sec.cm$^2$.°C. and a layer thickness of 3–10 mm. On the first elastic layer 141, the second elastic layer 151 having a thickness smaller than the first elastic layer is formed. The second elastic layer 151 has, in this embodiment, a thermal conductivity of not more than $0.4\times10^{-3}$ cal.cm/sec.cm$^2$.°C. and a layer thickness of 0.01–0.5 mm. On the second elastic layer 151, a resin layer 16 having a further smaller thickness, that is, smaller than the thickness of the second elastic layer, is formed. The resin layer 16 is made of fluorine resin material such as PFA resin and PTFE resin. In this embodiment, the resin layer 16 has a layer thickness of 5–35 microns, a film strength of not less than 50 kg/cm$^2$. Various experiments have revealed that the thermal conductivity of the first elastic layer is preferably not less than $0.8\times10^{-3}$ cal.cm/sec.cm$^2$/°C., and that the thermal conductivity of the second elastic layer is not more than $0.4\times10^{-3}$ cal.cm/sec.cm$^2$/°C. As regards the layer thicknesses, good results are provided if the thickness of the first elastic layer is larger than that of the second elastic layer, which is larger than that of the resin layer. Preferably, the thickness of the first elastic layer is larger than twice that of the second elastic layer, and sum of the thickness of the first elastic layer and the thickness of the second elatic layer is larger than six times the thickness of the resin layer.

Each of the heating roller 1 and the back-up roller 10 has a symmetry about a longitudinal center, and preferably the heating roller 1 (or the pressing roller 10) is reverse-crowned in which the diameter in the longitudinal center portion is slightly smaller than those at the longitudinal ends.

The results of this example used in the heating roller and the back-up roller incorporated in the image fixing apparatus shown in FIG. 1 will be described.

As for the heating roller 1, an aluminum core metal 2 was prepared and finished such that the outer diameter at the central portion was 58.3 mm with an amount of the reverse-crown of 150 microns, and the thickness thereof is 6.5 mm. The surface thereof was sand-blasted to be degreased and then was dried. The core metal 2 was coated with a primer and then was wrapped with a vulcanizable type silicone rubber sheet (the thermal conductivity is $1.5\times10^{-3}$ cal.cm/sec.cm$^2$/°C.) The thickness thereof was 0.35 mm. The non-vulcanized silicone rubber roller was coated with a vulcanizable type silicone rubber sheet having a good thermal conductivity ($0.3\times10^{-3}$ cal.cm/sec.cm$^2$/°C.) in which PFA particles were dispersed (5–30% by weight relative to silicone rubber of 100%). Then, it was press-vulcanized for 30 min at 170° C., and thereafter, a secondary vulcanization was effected for 15 min. at 100° C. and for 30 min. at 200° C., and for one hour at 220° C. It was machined to provide a rubber thickness of 0.5 mm. The first elastic layer was 0.4 mm and the second elastic layer was 0.1 mm.

On the silicone rubber roller thus produced, PFA particles were sprayed in 20 microns thickness, and it was sintered by a sintering method by which the silicone rubber layer was not extremely heat-deteriorated. The back-up roller 10 was produced in the same manner as the heating roller 1. However, the core metal 12 was made of iron. The materials of the first and second elastic layers 141 and 151 and the resin layer 16 were the same as those of the heating roller 1. The layer thicknesses were 6 mm in the first elastic layer 14, 0.1 mm in the second elastic layer 15 and 20 microns in the resin layer 16. The outer diameter of the roller was the same as that of the heating roller 1.

With the heating roller 1 and the back-up roller 10 used, the surface temperature of the heating roller 1 was maintained at 180° C. The image fixing operation was continued, and A4 size (JIS) sheets were processed at a speed of 200 mm/sec, 30 sheets/min. When the ambient temperature was 15° C., good image fixing properties were shown, and the production of the toner off-set was reduced to not more than one fifth the conventional good image fixing apparatus. The usable period of the cleaning member was increased up to not less than 5 times. When the room temperature was 32.5° C., and the humidity was 85%, the transfer sheets were not buckled, and they were properly stacked on a sorter or the like with very little curl. The images were not collapsed, and the quality thereof was high.

Those were maintained even after 300,000 sheets were fixed. Even after 500,000 sheets were fixed, no trouble occurred.

In this example, the roller includes the first elastic layer having the good thermal conductivity on the core metal, and the second elastic layer having a good thermal insulation on the first elastic layer, wherein the second elastic layer contains resin materials, and therefore the second elastic layer the heat flows at the time of the resin layer sintering, but since the second elastic layer is sufficiently thermal-insulative, the thermal damage of the first elastic layer inside thereof is eased. In addition, the resin material in the outer fluorine resin layer and the second elastic layer is fused at the time of sintering, and therefore, they are fused together to provide the strong bonding therebetween. From this standpoint, it is preferable that the resin material in the second elastic layer is the same as that of the outer coating. The bonding between the first elastic layer and the second elatic layer is not so strong if the second elastic layer is formed after the first elastic layer is vulcanized. In this example, however, the first elastic layer and the second elastic layer are simultaneously vulcanized, and therefore, the bonding strength therebetween is also strong. For this reason, even if the thickness of the second elastic layer is small, there occurs no peeling from the first elastic layer.

In this example, the thickness of the first elastic layer is larger than that of the second elastic layer, and therefore, even if the second elastic layer is deteriorated in the rubber property, desired rubber properties (impact resilience or the like) can be generally maintained as a whole. When the heating roller 1 and the back-up roller 10 are incorporated in an image fixing apparatus, the thermal resistance from the inside to the outside is small due to the good thermal conductivity of the first elastic layer. By this, the fixing property and the durability are good enough.

In this example, the elastic layer may be of fluorine rubber, EPDM or the like, depending on the usage thereof. Also, the resin layer may be of silicone resin or the like.

While the invention has been described with reference to the structures disclosed herein, it is not confined to the details set forth and this application is intended to cover such modifications or changes as may come within the purposes of the improvements or the scope of the following claims.

What is claimed is:

1. A rotatable member for fixing an image, comprising:

a rubber layer; and a fluorine resin layer on said rubber layer, wherein resin particles having a particle size of not more than 1 micron are dispersed in said rubber layer.

2. A rotatable member according to claim 1, wherein said fluorine resin layer is positioned directly on said rubber layer.

3. A rotatable member according to claim 1, further comprising a bonding layer bonding said fluorine resin layer on said rubber layer, said bonding layer containing fluorine resin.

4. A rotatable member according to claim 1, wherein the content by weight of said fluorine resin particles is 5–30% relative to rubber material of said rubber layer.

5. A rotatable member according to claim 1, wherein said rubber layer is thicker than said fluorine resin layer.

6. A rotatable member according to claim 1, wherein said rubber layer is a silicone rubber layer.

7. A rotatable member according to claim 1, further comprising a core member on which said rubber layer is provided.

8. A rotatable member according to claim 1, wherein fluorine resin particles are dispersed in said rubber layer, wherein said fluorine resin particles have a particle size of not more than 0.5 micron.

9. A rotatable member according to claim 1, wherein said resin particles are fluorine resin particles, wherein said fluorine resin layer and said fluorine resin particles are composed of PTFE resin.

10. A rotatable member according to claim 1, wherein said resin particles are fluorine resin particles, wherein said fluorine resin layer and said fluorine resin particles are composed of PFA resin.

11. An image fixing apparatus, comprising:

a heating roller heated by a heater;

a back-up member cooperating with said heating roller to form a nip, through which an image carrying member carrying an unfixed image is passed to fix the image by heat and pressure;

said heating roller including;

a rubber layer; and a fluorine resin layer on said rubber layer;

wherein said rubber layer contains resin particles dispersed therein and having a particle size of not more than 1 micron.

12. An image fixing apparatus according to claim 11, wherein said fluorine resin layer is positioned directly on said rubber layer.

13. An image fixing apparatus according to claim 11, further comprising a bonding layer bonding said fluorine resin layer on said rubber layer, said bonding layer containing fluorine resin.

14. An image fixing apparatus according to claim 11, wherein the content by weight of said fluorine resin particles is 5–30% relative to rubber of said rubber layer.

15. An image fixing apparatus according to claim 11, wherein said rubber layer is thicker than said fluorine resin layer.

16. An image fixing apparatus according to claim 11, wherein said rubber layer is a silicone rubber layer.

17. An image fixing apparatus according to claim 11, further comprising a core member on which said rubber layer is provided.

18. An image fixing apparatus according to claim 11, wherein said fluorine resin particles have a particle size of not more than 0.5 micron.

19. An image fixing apparatus according to claim 11, wherein said fluorine resin layer and fluorine resin particles are composed of PTFE resin.

* * * * *

UNITED STATES PATENT AND TRADEMARK OFFICE

CERTIFICATE OF CORRECTION

PATENT NO. : 5,253,027
DATED : October 12, 1993
INVENTOR(S) : MASAHIRO GOTO

It is certified that error appears in the above-indentified patent and that said Letters Patent is hereby corrected as shown below:

COLUMN 1
Line 66, "of" should read --of an--.

COLUMN 4
Line 7, "partily" should read --partly--;
Line 15, "is" should read --are--;
Line 17, "heatig" should read --heating--.

COLUMN 8
Line 32, "fixig" should read --fixing--;
Line 68, "exitence" should read --existence--.

COLUMN 9
Line 46, "elatic" should read --elastic--.

COLUMN 10
Line 14, "elatic" should read --elastic--.

COLUMN 11
Line 25, "elatic" should read --elastic--.

Signed and Sealed this
Twelfth Day of July, 1994

Bruce Lehman

*Attest:*

BRUCE LEHMAN

*Attesting Officer*

*Commissioner of Patents and Trademarks*